United States Patent [19]

Higgins

[11] Patent Number: 4,545,434

[45] Date of Patent: Oct. 8, 1985

[54] WELL TOOL

[76] Inventor: Brian D. Higgins, 1308 Cherokee St., Arlington, Tex. 76012

[21] Appl. No.: 603,435

[22] Filed: Apr. 24, 1984

Related U.S. Application Data

[63] Continuation-in-part of Ser. No. 374,066, May 3, 1982.

[51] Int. Cl.[4] ..... E21B 23/00

[52] U.S. Cl. ..... 166/217; 166/237; 166/125

[58] Field of Search ..... 166/118, 125, 217, 237, 166/386, 387

[56] References Cited

U.S. PATENT DOCUMENTS

| | | | |
|---|---|---|---|
| 2,862,560 | 12/1958 | Bostock et al. | 166/125 |
| 3,102,593 | 9/1963 | Sizer | 166/125 |
| 3,507,329 | 4/1970 | Stone, Jr. | 166/217 |
| 3,670,821 | 6/1972 | Tamplen | 166/217 |
| 3,856,081 | 12/1974 | Canalizo | 166/217 |
| 4,043,392 | 8/1977 | Gazda | 166/217 |
| 4,161,984 | 7/1979 | Watkins | 166/382 |

*Primary Examiner*—Stephen J. Novosad
*Assistant Examiner*—William P. Neuder
*Attorney, Agent, or Firm*—H. Mathews Garland

[57] ABSTRACT

Well tools for running and setting a well safety valve including a lock mandrel for releasably locking the valve at a no-go landing nipple in a well bore and a running tool for running and setting the lock mandrel. The lock mandrel includes a body provided with a no-go ring, locking dogs on the body, and an expander sleeve movable upwardly in the body for expanding and locking the dogs. The running tool includes a tubular core having an end engageable with an operating tube of the safety valve, an upper latch assembly for engaging the lock mandrel housing to couple the running tool with the lock mandrel, a lower latch assembly for operating the expander sleeve of the lock mandrel to expand the mandrel locking dogs, and a head for connecting the running tool in a wireline tool string. The running tool has locking features which apply a force from a spring of the safety valve to the upper latch assembly to lock the running tool with the lock mandrel. A safety valve is connected to the lock mandrel which is coupled with the running tool. The assembly is lowered in a well to a no-go landing nipple. A control fluid pressure to the safety valve relieves the valve spring force from the running tool core and the running tool is pulled upwardly expanding the lock mandrel dogs and releasing the running tool from the lock mandrel.

26 Claims, 46 Drawing Figures

WELL TOOL

This is a continuation-in-part of pending application No. 06/374,066 filed May 3, 1982.

This invention relates to well tools and more particularly relates to a lock mandrel and running tool for releasably locking a flow control device such as a safety valve in a flow conductor of a well.

In the well art, particularly that relating to oil and gas wells, it is standard practice to complete the wells using wireline equipment and methods which provides for substantial cost reductions during future well servicing operations. Wireline completion methods and equipment are illustrated and described in substantial detail in PETROLEUM ENGINEER INTERNATIONAL for August 1981 at pages 83–89. Presently available lock mandrels for sub-surface safety valves are of the extension hanger type which may present several operational problems when used with safety valves. Extension hanger locks are set by applying force in the same downward direction required for driving the safety valve into the landing nipple in which the valve is to be locked. The friction caused by packing between the safety valve and the landing nipple may require such excessive drive-down force that the lock mandrel is prematurely set. Further, it is possible to only partly engage the lock mandrel in the recess, establish control line pressure, and remove the running tool used to set the lock mandrel without any indication of a serious problem. One remedy which has been employed is a spring isolator device which eliminates major problems but still may malfunction. The locking sleeve of the extension hanger type lock must move in the opposite direction from flow to lock a safety valve. It is possible that flow could lift the locking sleeve releasing the lock.

It is, therefore, a particularly important object of the invention to provide a new and improved well tool.

It is another particularly important object of the invention to provide a new and improved lock mandrel and running tool assembly for use in wells to releasably lock devices such as safety valves at a landing nipple along the flow conductor of the well.

It is another object of the invention to provide a lock mandrel and running tool operable with wireline equipment.

It is another object of the invention to provide a running tool and a lock mandrel which is set by a force applied in a direction opposite to the direction of force required to drive the device such as a safety valve connected with the lock mandrel into the landing nipple in which the lock mandrel is set.

It is another object of the invention to provide a running tool with a lock mandrel which may be driven downwardly with unlimited force without the possibility of pre-setting the lock.

It is a further object of the invention to provide a running tool with a lock mandrel having a locking sleeve which moves to lock the mandrel in the direction of flow in the well thereby preventing well flow from releasing the lock.

It is a still further object of the invention to provide a running tool and a lock mandrel which requires that the lock mandrel be properly set and the well tool activated before the running tool can be released.

It is another object of the invention that safety valve control line integrity be established before the running tool can be released from the lock mandrel.

It is another object of the invention to provide a new and improved running tool for well apparatus such as a safety valve.

It is another object of the invention to provide a well device running tool which cannot be released from the well device until the device is properly set and activated in a well bore.

In accordance with the invention there are provided a lock mandrel for releasably locking a well device at a landing nipple in a flow conductor and a running tool for running and setting the lock mandrel. The lock mandrel includes a tubular body, circumferentially spaced locking keys for radial movement between lock and release positions and a key expander sleeve movable upwardly behind the keys for expanding and locking the keys outwardly. The running tool includes a head assembly for supporting the tool in a well, an upper latch assembly for releasably engaging the lock mandrel body, a lower latch assembly for releasably engaging the expander sleeve of the lock mandrel, and a core having an operating prong for engaging the operating tube of a safety valve connected with the lock mandrel to hold the safety valve open while running the lock mandrel and valve and maintain the mandrel latched to the running tool. The prong assembly applies a holding force to the upper latch keys when the running tool is coupled with the lock mandrel and safety valve when running the safety valve. The prong has locking and release surfaces for manipulating the lock mandrel and releasing the running tool from the lock mandrel. The safety valve and lock mandrel are driven downwardly into the landing nipple until a no-go ring on the lock mandrel engages a shoulder in the landing nipple. The running tool is then pulled upwardly expanding the locking keys on the lock mandrel. Pressure is then applied through a control line to the safety valve in the landing nipple relieving the upward force from the safety valve on the running tool prong to release the running tool. The running tool is releasable from the lock mandrel only after the expander sleeve is in the up position and the control line to the safety valve has been pressurized.

The details of preferred embodiments of the invention together with its objects and advantages will be evident from the following description taken in conjunction with the accompanying drawings wherein.

Figure 8A:
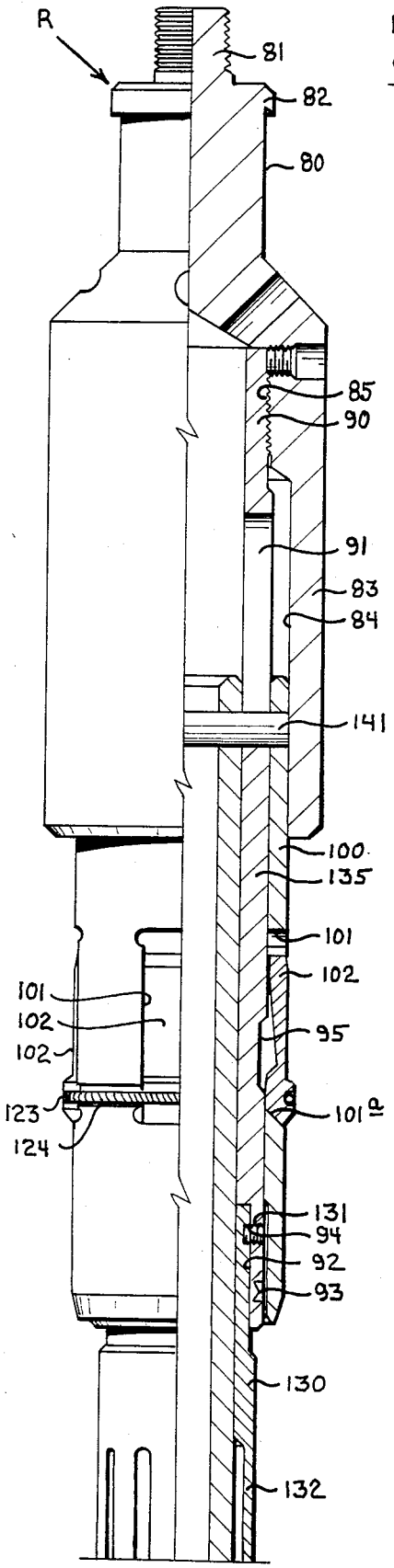
Figure 8B:
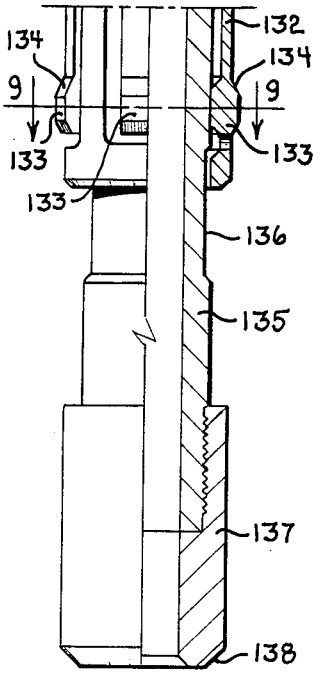
Figure 10:
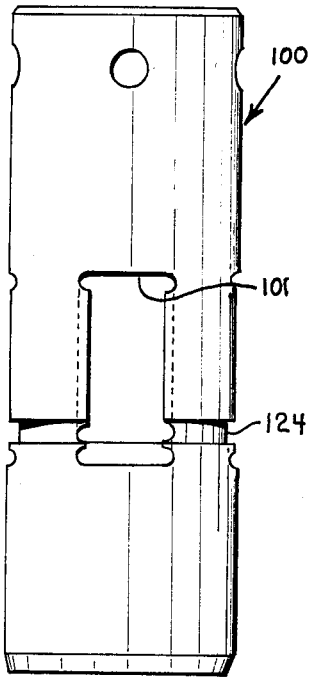
Figure 9:
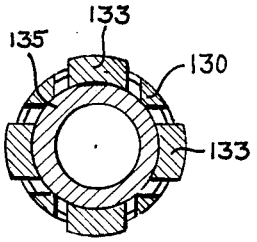
Figure 11:
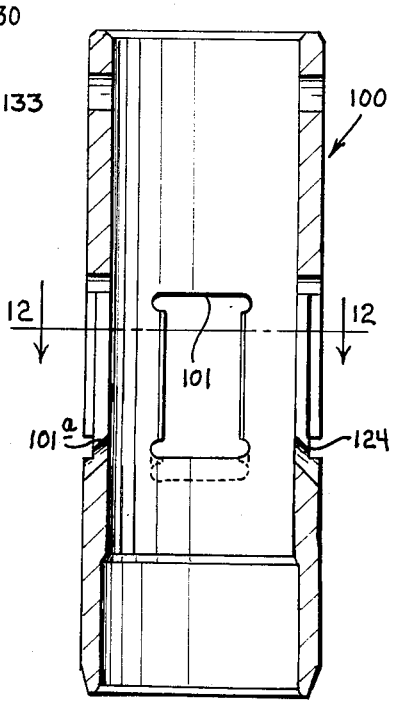
Figure 12:
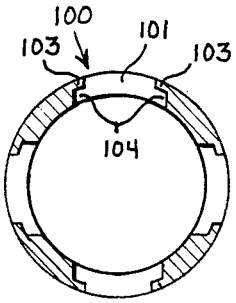
Figure 13:
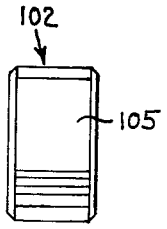
Figure 14:
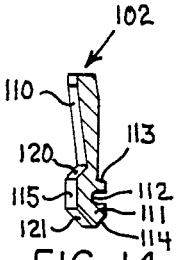
Figure 15:
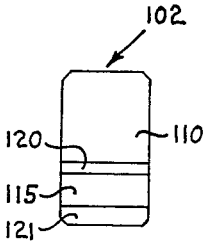
Figure 16:
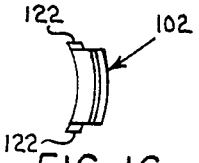
Figure 17A:
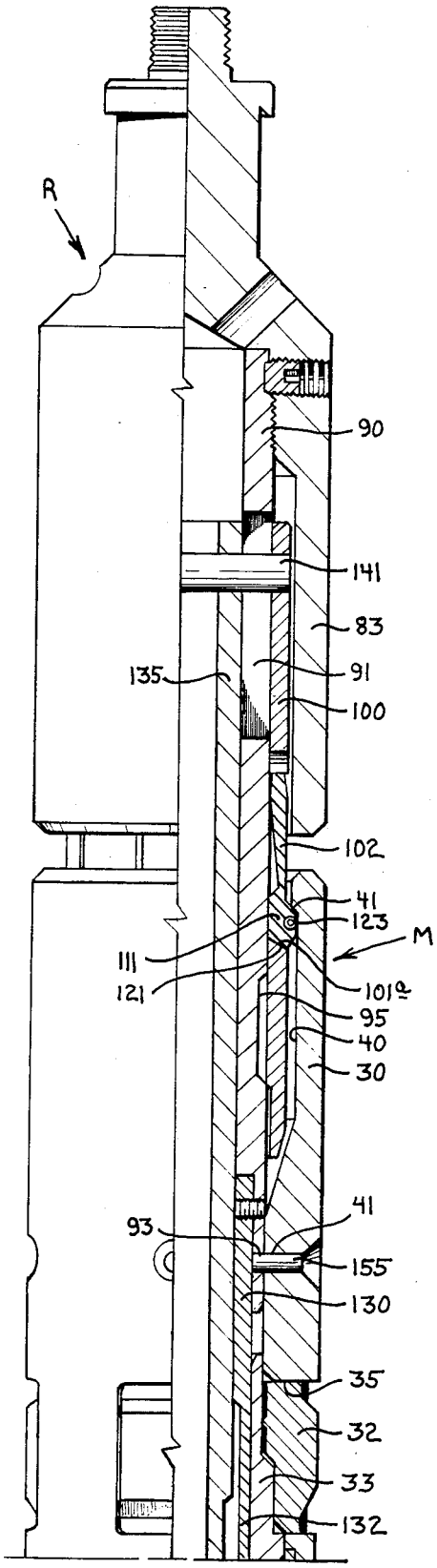
Figure 17B:
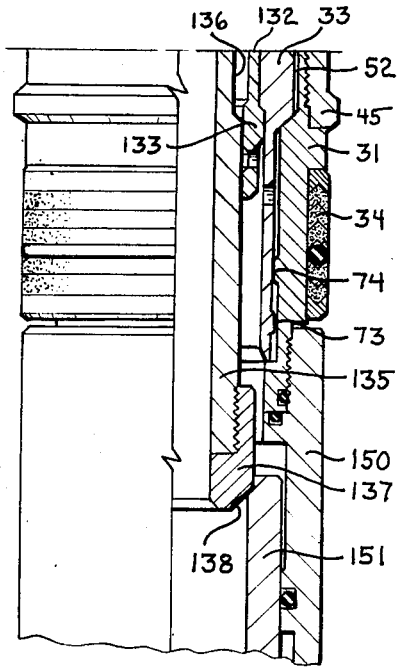
Figure 18A:
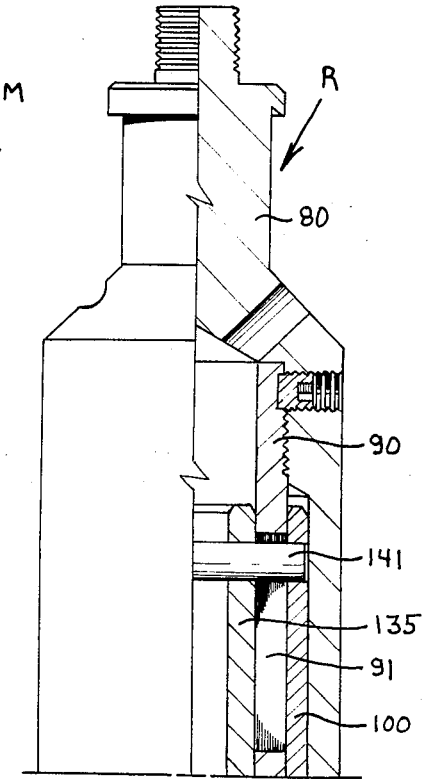
Figure 18B:
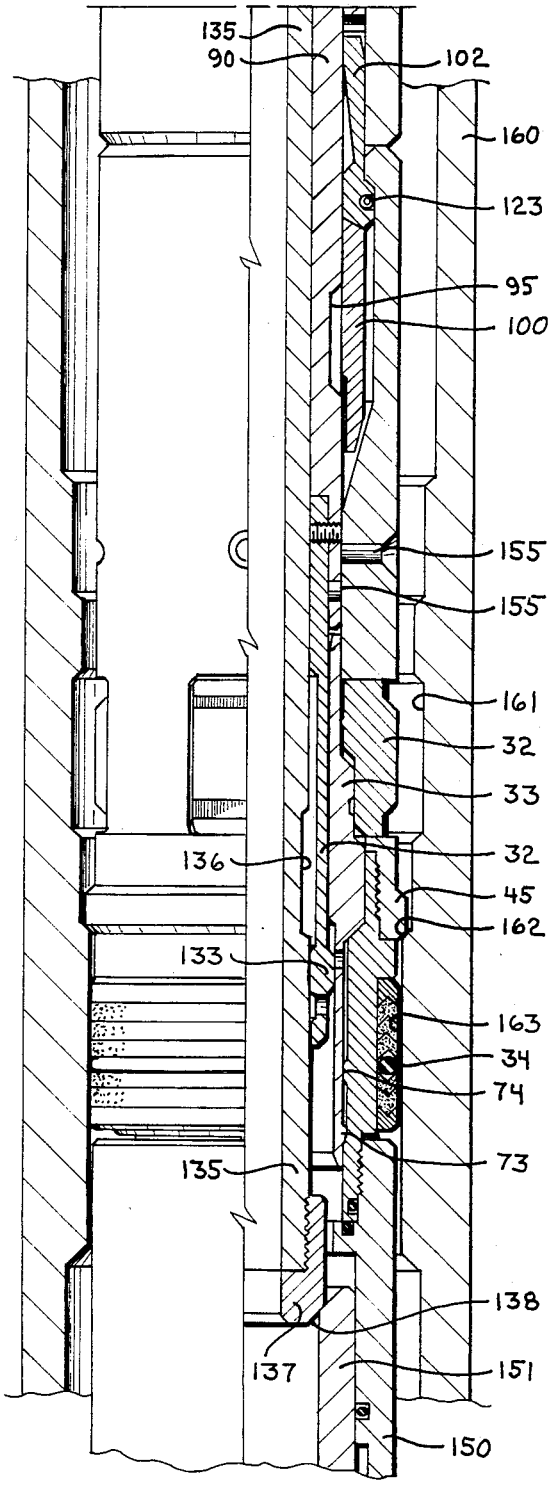
Figure 19A:
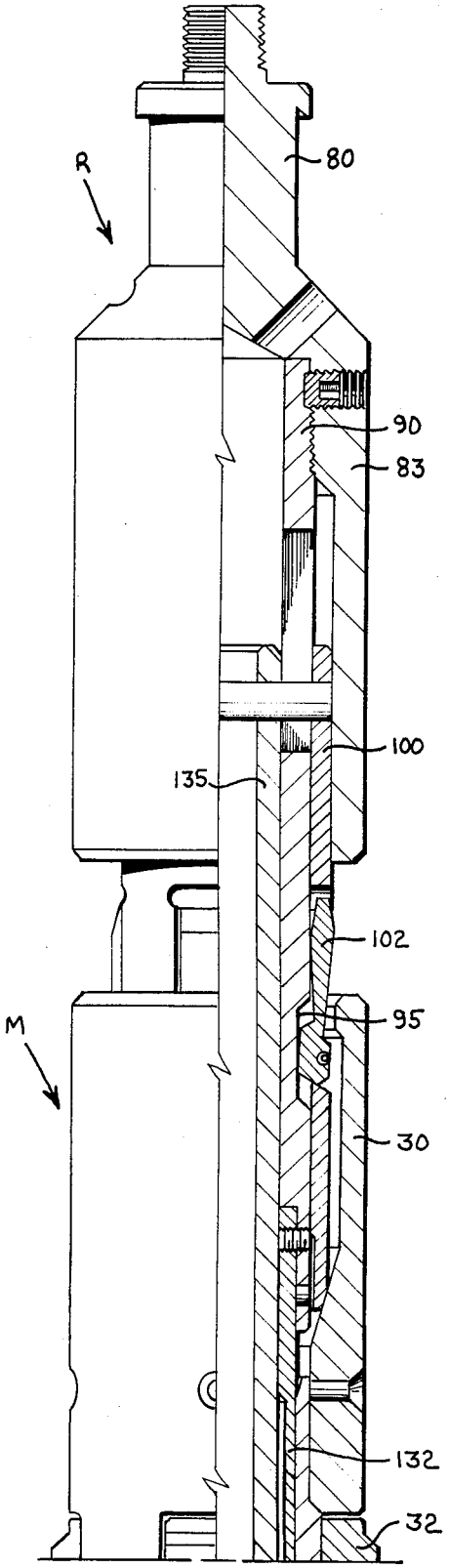
Figure 19B:
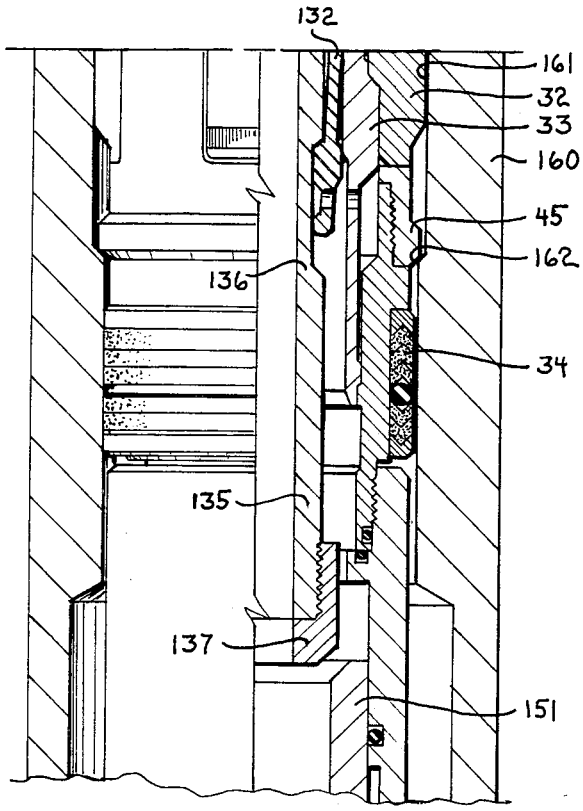
Figure 20A:
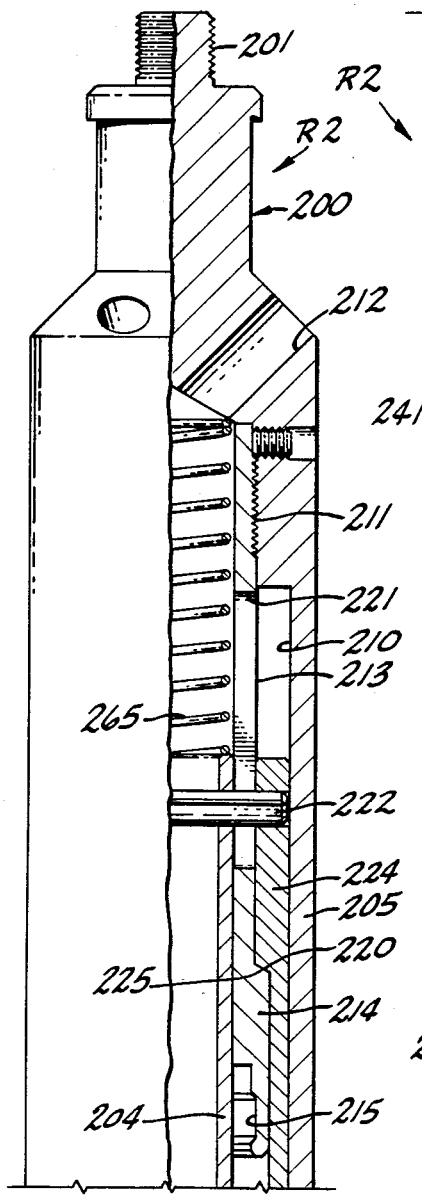
Figure 20B:
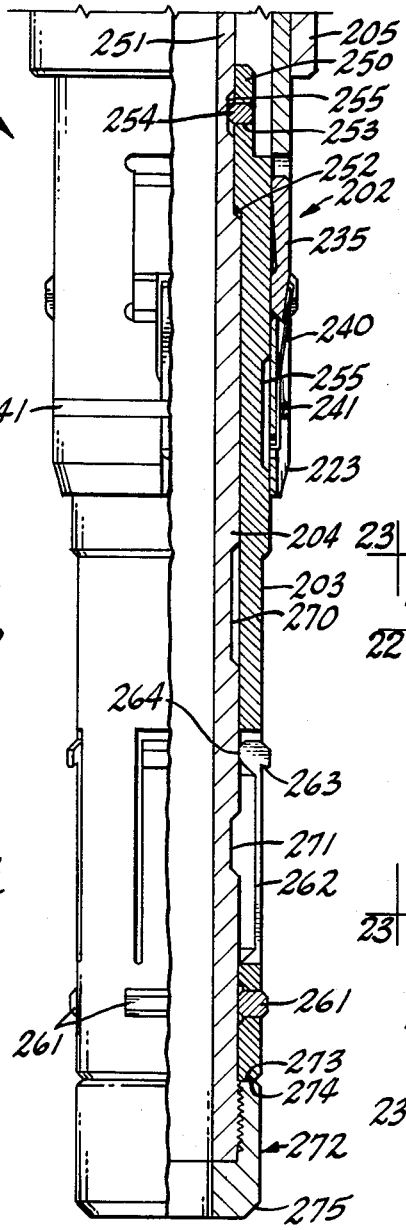
Figure 21:
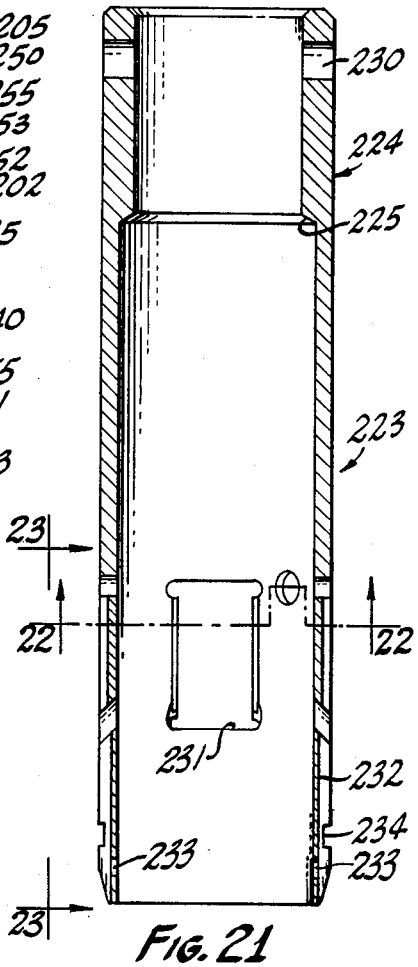
Figure 22:
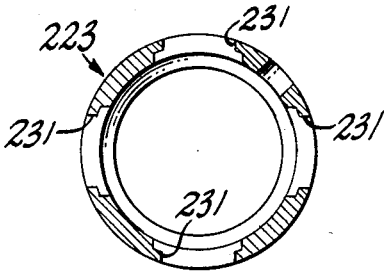
Figure 24:
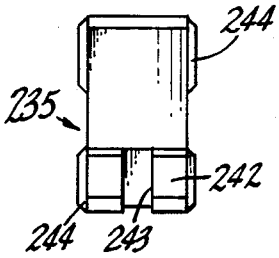
Figure 26:
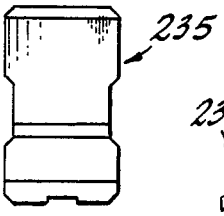
Figure 25:
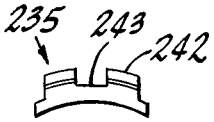
Figure 23:
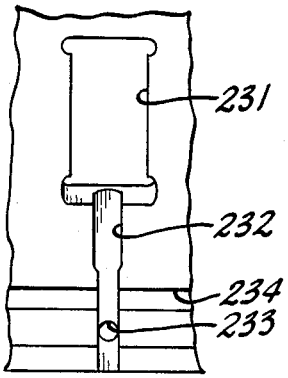
Figure 28:
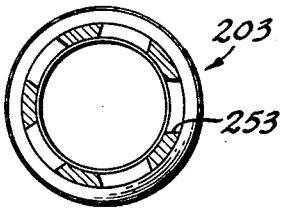
Figure 27:
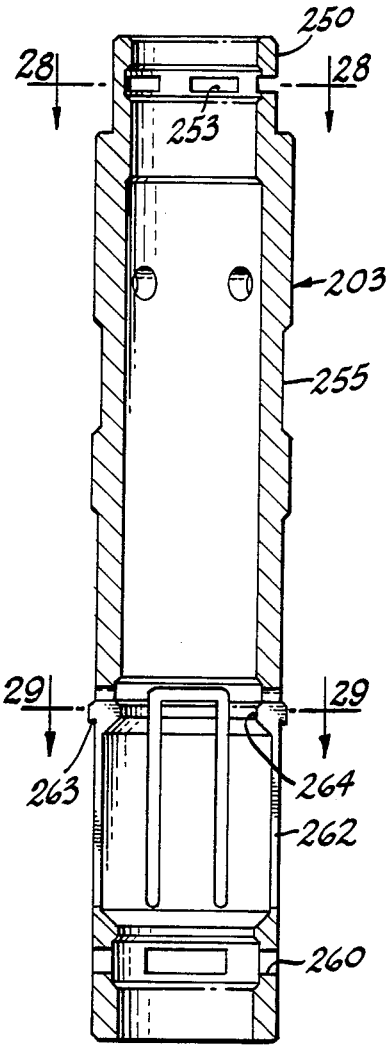
Figure 29:
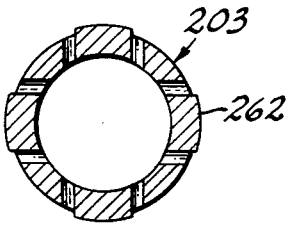
Figure 30:
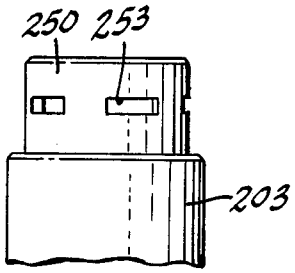
Figure 31:
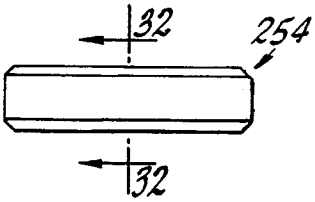
Figure 32:
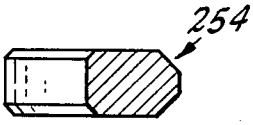
Figure 33:
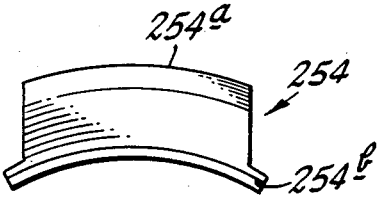
Figure 34A:
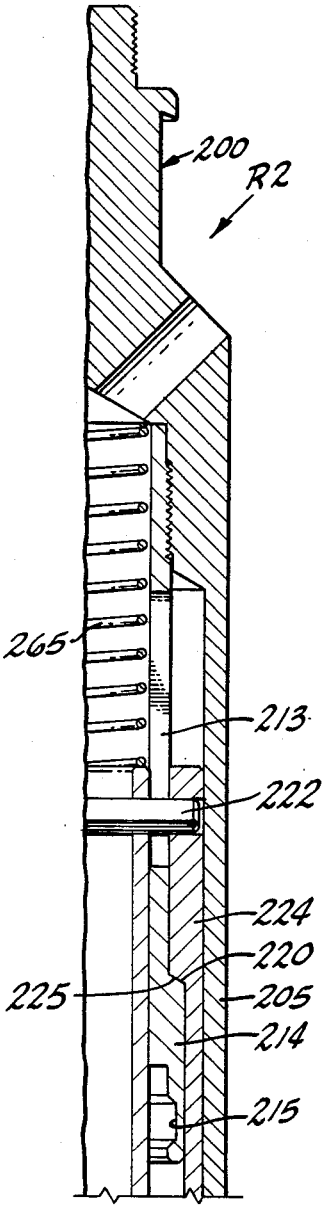
Figure 34B:
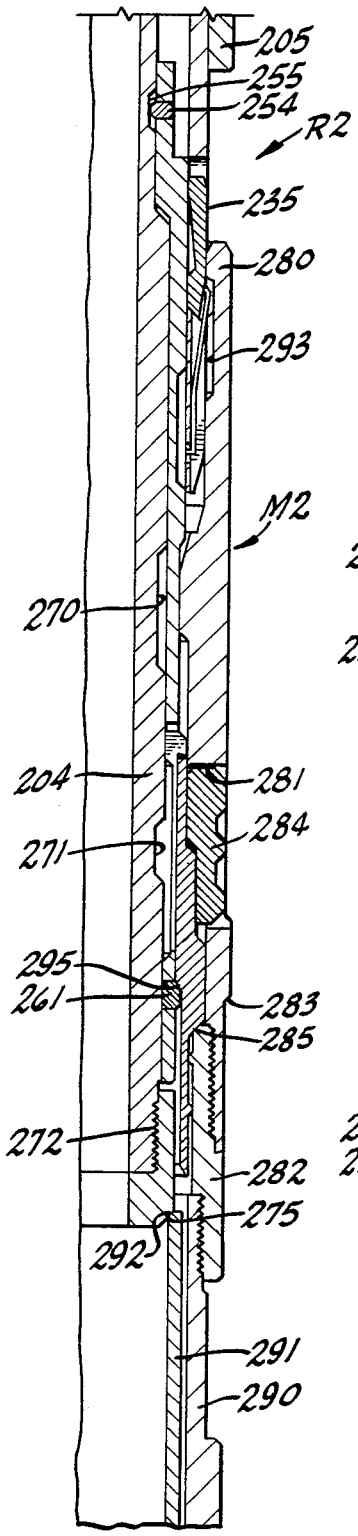
Figure 35A:
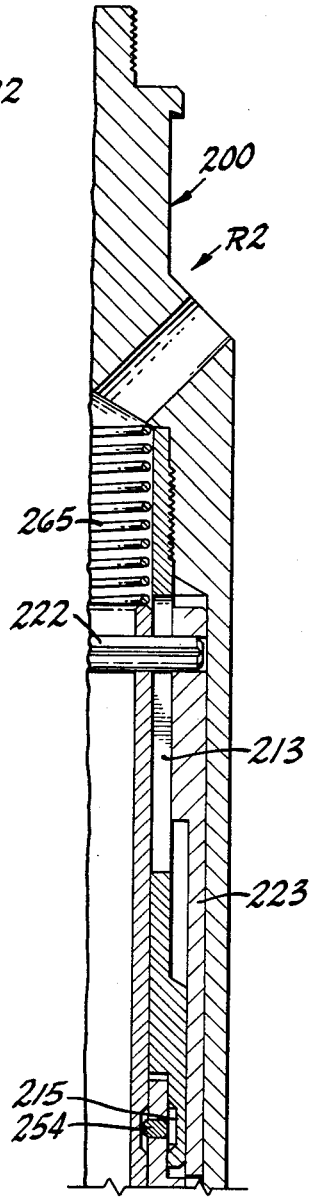
Figure 35B:
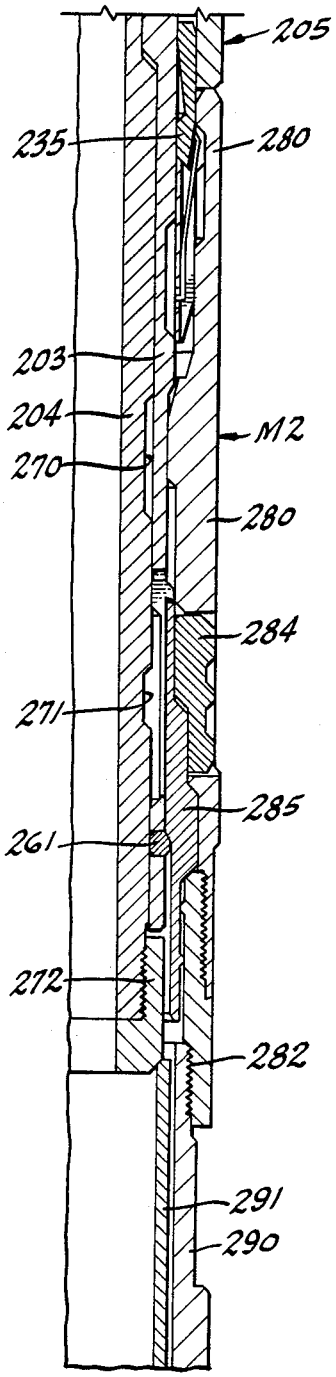
Figure 36A:
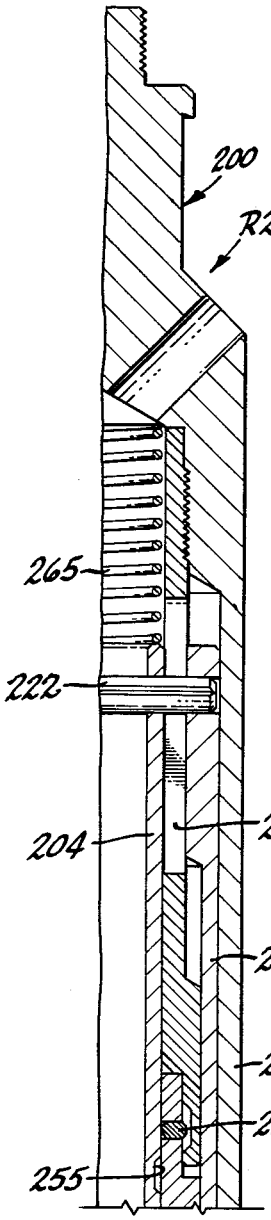
Figure 36B:
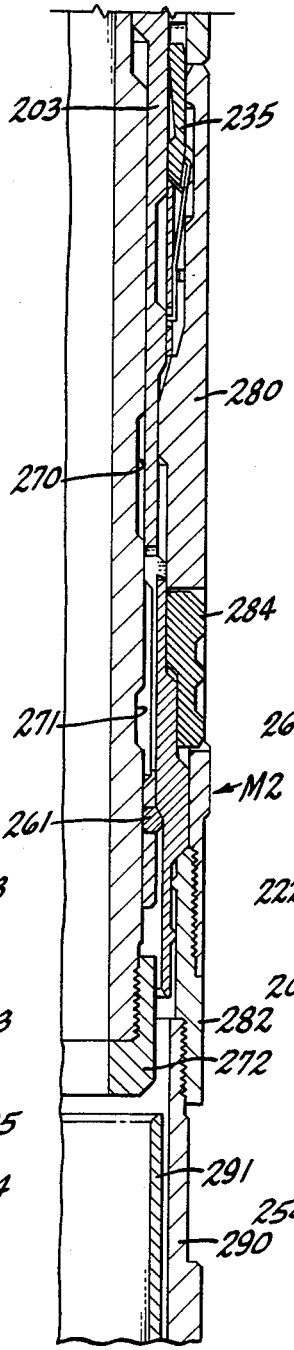
Figure 37A:
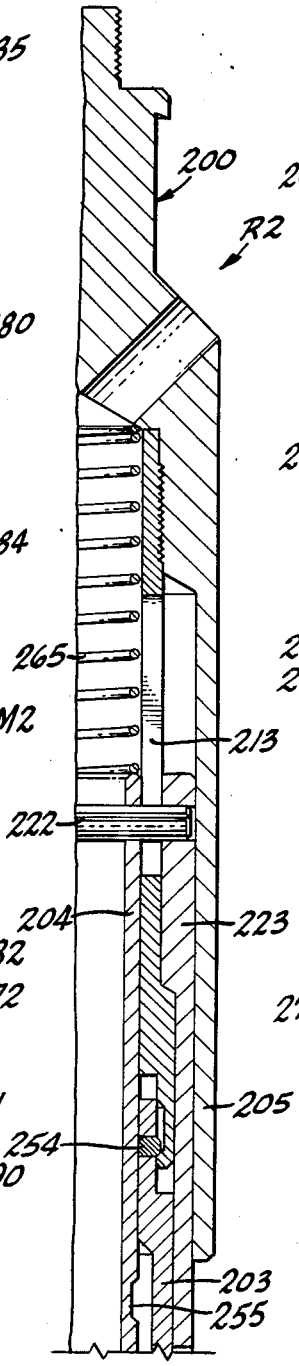
Figure 37B:
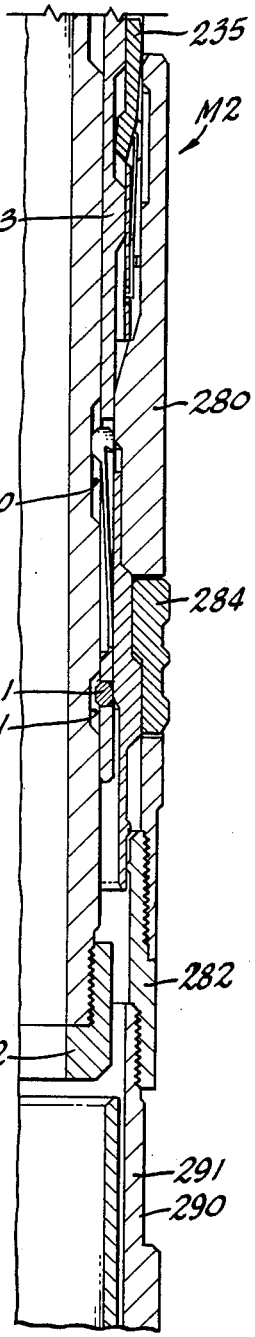

FIGS. 8A and 8B together form a longitudinal view in section and elevation of one form of the running tool of the invention;

FIG. 9 is a view in section along the line 9—9 of FIG. 8B;

FIG. 10 is a longitudinal view in elevation of the locking dog retainer sleeve of the running tool;

FIG. 11 is a longitudinal view in section of the sleeve of FIG. 10;

FIG. 12 is a view in section of the sleeve as seen along the line 12—12 of FIG. 11;

FIG. 13 is an outside view in elevation of one of the retainer dogs of the running tool;

FIG. 14 is a longitudinal view in section of the dog of FIG. 13;

FIG. 15 is an inside view in elevation of the retainer dog of FIG. 13;

FIG. 16 is a bottom end view of the retainer dog as seen in FIG. 14;

FIGS. 17A and 17B together are a longitudinal view in section and elevation of the running tool coupled with the lock mandrel of the invention connected into the upper end of a well safety valve as the safety valve is run into a well bore;

FIGS. 18A and 18B together form a longitudinal view in section and elevation of the running tool and lock mandrel of the invention coupled into the upper end of a well safety valve showing the valve and lock mandrel and a fragment of a landing nipple in section in which the safety valve and lock mandrel are landed; and FIGS. 19A and 19B taken together form a longitudinal view in section and elevation of the running tool, lock mandrel, and upper end portion of the safety valve in a landing nipple shown in fragmentary section in which the lock mandrel locking dogs are expanded into the lock recess of the landing nipple;

FIGS. 20A and 20B taken together are a longitudinal and sectional view of another embodiment of the running tool of the invention;

FIG. 21 is a longitudinal view in section of the retainer sleeve of the running tool of FIGS. 20A and 20B;

FIG. 22 is a view in section along the line 22—22 of FIG. 21;

FIG. 23 is a fragmentary view in elevation of a lower end portion of the retainer sleeve of FIG. 21 showing a retainer dog window as viewed along the line 23—23 of FIG. 21;

FIG. 24 is a view in elevation of the outside surfaces of one of the retainer dogs of the running tool;

FIG. 25 is a right end view in elevation of the retainer dog of FIG. 24;

FIG. 26 is an inside view in elevation of the retainer dog of FIGS. 24 and 25;

FIG. 27 is a longitudinal view in section and elevation of the lower setting sleeve of the running tool of FIGS. 20A and 20B;

FIG. 28 is a view in section along the line 28—28 of FIG. 27;

FIG. 29 is a view in section along the line 29—29 of FIG. 27;

FIG. 30 is a fragmentary view in elevation of the upper end portion of the lower setting sleeve of FIG. 27;

FIG. 31 is an enlarged inside view of the transfer lugs of the running tool of FIGS. 20A and 20B;

FIG. 32 is a view in section and elevation along the line 32—32 of the transfer lug of FIG. 31;

FIG. 33 is a top end view in elevation of the lug of FIG. 31;

FIGS. 34A and 34B taken together form a longitudinal view in half section of a lock mandrel and the running tool of FIGS. 20A and 20B in the running mode of the tools;

FIGS. 35A and 35B taken together form a longitudinal half section of the running tool and lock mandrel in the drivein mode for inserting the lock mandrel into a landing nipple in a well;

FIGS. 36A and 36B taken together form a longitudinal half section of the running tool and lock mandrel after the lock mandrel is inserted into a landing nipple and pressure has been applied to a safety valve supported from the lock mandrel preparatory to expanding the locking keys on the lock mandrel; and FIGS. 37A and 37B taken together form a longitudinal view in half section after expansion of the keys on the lock mandrel and release of the running tool from the lock mandrel.

Figure 1:
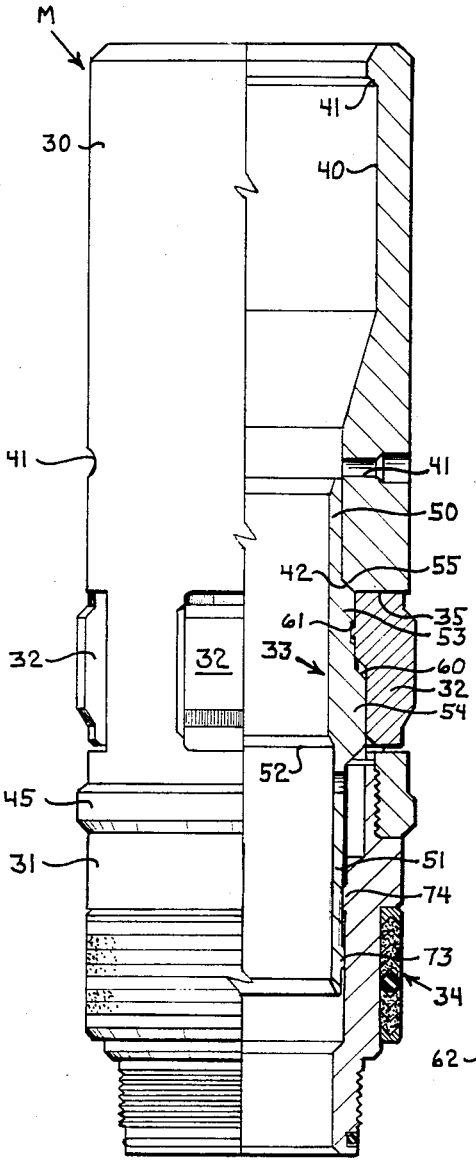
FIG. 1 is a longitudinal view in section and elevation of the lock mandrel of the invention.

Referring to FIG. 1, a lock mandrel M includes a tubular body formed by a locking dog retainer sleeve 30 and a packing mandrel 31, radially movable locking dogs 32, a locking dog expander sleeve 33, and a packing assembly 34. The dogs 32 are radially movable in windows 35 provided in the retainer sleeve 30. The expander sleeve 33 moves within the locking dogs between an upper locking position shown in FIG. 1 and a lower dog release position.

Figure 2:
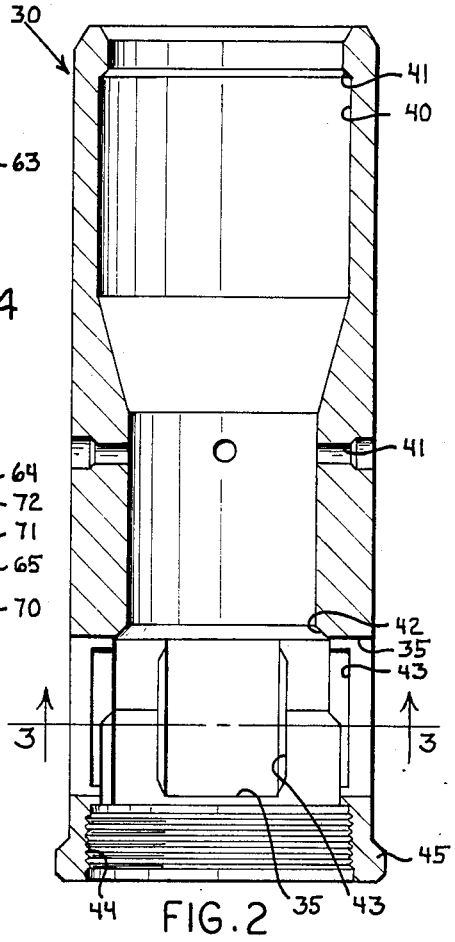
FIG. 2 is a longitudinal view in section of the key retainer sleeve of the lock mandrel.
Figure 3:
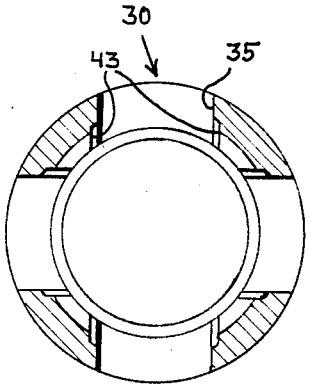
FIG. 3 is a view in section along the line 3—3 of FIG. 2.

Referring to FIGS. 2 and 3, the locking dog retainer sleeve 30 has an internal annular locking recess 40 having an upper end shoulder surface 39 to receive upper locking keys on the running tool of the invention used to set the lock mandrel and safety valve in a landing nipple. The sleeve 30 has a plurality of circumferentially spaced shear pin holes 41 for securing the lock mandrel to a running tool. The windows 35 in the sleeve 30 are circumferentially spaced, each window being sized and shaped to receive and retain one of the locking dogs 32 with the sleeve allowing the dog to move radially between an inward release position and an outward expanded locking position. The bore of the lower portion of the sleeve 30 extending within the windows 35 is graduated and shaped to accommodate the locking dog expander sleeve 33. A tapered stop shoulder 42 along the sleeve bore limits the upward movement of the expander sleeve 33. As evident in FIGS. 2 and 3 each of the windows 35 has longitudinal inner side retainer recesses 43 which receive retainer flanges along the side edges of the locking dogs 32 to hold the dogs in the windows of the sleeve 30. The lower end portion of the sleeve 30 is internally threaded at 44 for connection of the sleeve on the upper end of the packing mandrel 31. An external annular no-go ring 45 is formed on the lower end portion of the sleeve 30 to limit the downward movement of the mandrel M in a landing nipple.

The locking dog expander sleeve 33 is illustrated in FIG. 1 is a tubular member having upper and lower guide or bearing end portions 50 and 51. The upper end portion 50 of the sleeve 33 slides within the bore of the sleeve 30 above the stop shoulder 42 while the lower guide portion 51 of the sleeve slides within the bore of the packing mandrel 31. The bore of the expander sleeve 33 is graduated having an enlarged lower end portion providing a tapered operating shoulder 52 for engagement by an operating key on the running tool to lift the expander sleeve in moving the locking dogs 32 outwardly to lock positions. The outside diameter of the central portion of the expander sleeve 33 is also graduated providing an upper central portion 53 and a larger lower central portion 54. A tapered cam surface 55 is provided on the expander sleeve on the upper end of the portion 53. A tapered cam surface 60 is provided on the sleeve 33 between the portions 53 and 54. An external annular latch recess 61 is provided on the expander sleeve portion 53 to releasably latch the expander sleeve in the upper locked position.

Figure 4:
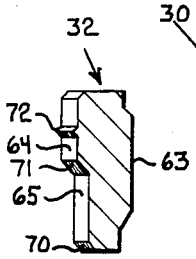
FIG. 4 is a longitudinal side view in section of one of the locking keys of the lock mandrel of FIG. 1.
Figure 5:
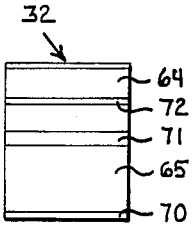
FIG. 5 is an outside view in elevation of the key of FIG. 4.
Figure 6:
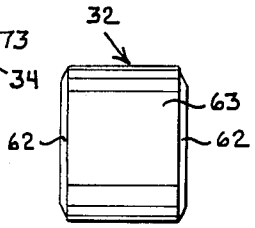
FIG. 6 is an inside view in elevation of the key of FIG. 4.
Figure 7:
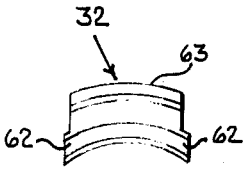
FIG. 7 is a bottom end view of the retainer key as seen in FIG. 6.

Each of the locking keys 32 as illustrated in FIGS. 4–7 is a circular arcuate segment shaped to fit within the windows 35 of the sleeve 30 and having an outer locking profile and an inner profile engageable by the expander sleeve 33 for expanding and locking the keys. The side edges of the locking dogs 32 each has an integral longitudinal retainer flange 62 which fits the retainer recesses 43 along the windows 35 of the sleeve 30 to hold the locking dogs 32 in the windows at the expanded positions as shown in FIG. 1 of the dogs. Each of the dogs 32 has an outer locking boss surface 63 shaped to fit within a locking recess of a landing nipple for locking the lock mandrel M in the landing nipple. The inside faces of the dogs 32 as particularly shown in FIGS. 4 and 5 are graduated surfaces defined by an upper inside face 64 and a lower inside face 65. The lower end of the face 65 has an inside cam surface 70. Between the surfaces 64 and 65 each dog has a sloping cam surface 71. The face 64 also has a latching lip or ridge 72 which is engageable in the latch recess 61 of the sleeve 33 so that when the sleeve is in the upper locked position of FIG. 1, the expander sleeve is releasably locked at the upper position at which the dogs 32 are expanded. The cam surfaces 70 and 71 on the inside faces of the dogs 32 cooperate with cam surfaces on the expander sleeve 33 for moving the dogs outwardly to the locked positions as the retainer sleeve 33 is lifted upwardly from a lower release position to the upper end lock position of FIG. 1. Additionally for latching the sleeve 33 at the upper end position the sleeve 33 has an external annular latch flange 73 provided around the lower end portion 51 of the sleeve while the packing mandrel bore has an internal annular latch flange or shoulder 74. At the upper locked position of the sleeve 33 the latch flange 73 on the sleeve moves above the latch flange 74 within the bore of the packing mandrel to further aid in holding the expander sleeve 33 at the upper locking position.

Referring to FIGS. 8A and 8B, the running tool R embodying the features of the invention has a fishing neck 80 provided with standard wireline features for connection in a wireline tool string including a reduced threaded upper end portion 81 and an external annular flange 82. The fishing neck has an enlarged lower end skirt portion 83 which has a bore 84 provided with a reduced internally threaded upper end portion 85. An upper setting sleeve 90 is secured along an externally threaded upper end portion into the threaded bore portion 85 of the fishing neck. The fishing neck skirt 83 and the upper end portion of the sleeve 90 are in concentric spaced relation. The sleeve 90 has a pair of longitudinal slots 91 positioned along opposite sides of the sleeve. The lower end portion of the setting sleeve 90 is counterbored at 92 and provided with a shear pin hole 93 and a set screw hole 94. Above the set screw hole 94, the sleeve 90 has an external annular latch release recess 95. A latch key retainer sleeve 100 is telescoped in sliding relation over the lower end portion of the sleeve 90 into the skirt 83 between the sleeve 90 and the skirt. The sleeve 100 has circumferentially spaced windows 101 shaped to receive and retain a latch key 102. As shown in FIG. 12 each of the windows 101 of the sleeve 100 has longitudinal opposite side key retainer lips or flanges 103 defining along each longitudinal side edge of the windows a longitudinal recess 104. As illustrated in FIGS. 13–16 each of the latch keys 102 is an arcuate circular segment having an outer face 105 and an inner face 110. The outer face has a locking boss 111 provided With a transverse garter spring recess 112 and extending between an upper cam surface 113 and a lower cam surface 114. The locking heads of the keys defined by the outer bosses 111 have inner bosses 115 extending between a sloping cam surface 120 and a sloping cam surface 121. As shown in FIG. 16, the longitudinal side edges of the keys 102 are each provided with an inside retainer flange 122 which fit within the window edge recesses 104, FIG. 12, and are engageable with the retainer flanges 103 along the window edges of the key retainer sleeve 100 to retain the keys in the windows while permitting the keys to move radially inwardly and outwardly. The keys 102 are fitted within the windows and held by a garter spring 123 which completely encircles the keys and the sleeve 100. The garter spring passes through the outer recess 112 in the latching heads of the keys and between the keys through a segment of the external annular recess 124 formed in the outer surface of the sleeve 100 intersecting the lower ends of the windows 101. The spring binds the keys within the windows while allowing the latch head ends of the keys to move radially between expanded latching positions and retracted release positions. The keys 102 are movable longitudinally with the sleeve 100 between expanded latching positions and contracted release positions. When the latching heads of the keys are aligned with the release 95 of the sleeve 90 the garter spring 123 pulls the latching heads of the keys inwardly to release positions.

Continuing with reference to FIGS. 8A and 8B, a lower setting sleeve 130 is telescoped along an upper end portion into the counterbore 92 of the upper setting sleeve 90. A set screw 131 through the lower end portion of the sleeve 90 secures the lower setting sleeve with the upper setting sleeve. The lower portion of the lower setting sleeve has a plurality of circumferentially spaced downwardly extending longitudinal collet fingers 132 each having a latch head 133. Each of the collet finger latch heads has an upper outer tapered cam surface 134 for shifting the locking dog expander sleeve 54 in the mandrel M and thereafter for camming the latch heads 133 inwardly to release positions. It will be obvious in FIGS. 8A and 8B that the collet fingers 132 join the main body of the sleeve 130 at the upper ends of the fingers while the fingers including the latch heads 133 are free to spring inwardly and outwardly for latching and operation of the lock mandrel M. A tubular core 135 is telescoped in sliding relationship into the upper setting sleeve 90 through the lower setting sleeve 130. The core has an external annular release recess 136 which allows the latch heads 133 on the collet fingers 132 to move inwardly to release positions when the latch heads are aligned with the recess 136. When the latch heads are misaligned from the recess 136 and thus are along the larger diameter of the core above the recess, the outer surface of the core holds the latch heads 133 outwardly at operating positions. The upper end portions of the latch key retainer sleeve 100 and the core 135 are secured together by a spiral pin 141 which extends from opposite sides of the sleeve 100 through the longitudinal slots 91 of the upper setting sleeve 90 and the opposite sides of the core 135. The pin 141 secures the key retainer sleeve 100 with the core so that the two members are rigidly connected together and thus movable as a common unit. Similarly the fishing neck and the upper setting sleeve 90 are secured together moving as a unit relative to the key retainer sleeve 100 and the core 135. When the fishing neck is raised or lowered the upper setting sleeve 90 is correspondingly raised or lowered relative to the key retainer sleeve 100 and the core 135. Movement of the fishing neck 80 moves the upper setting sleeve 90 relative to the key retainer sleeve 100 which holds the upper latch keys 102 and thus the latch key release recess 95 is moved relative to the keys 102. Similarly movement of the fishing neck moves the collet fingers 132 which depend from the sleeve 130 so that the collet heads 133 are moved along the core 135 relative to the release recess 136. The upper latch key heads 111 and the lower latch heads 133 on the collet fingers 132 function to connect the running tool R with the lock mandrel M, operate the lock mandrel M, and release the running tool from the lock mandrel at the different relative positions of the upper and lower setting sleeve, the upper latch keys, and the collet fingers on the lower setting sleeve.

The lock mandrel M and the running tool R are useful for running and setting standard remote controlled wireline tubing safety valves in no-go type nipples. A typical safety valve with which the lock mandrel tool is operable is an Otis type DK tubing safety valve illustrated at page 3998 of the 1974–1975 edition of the *Composite Catalog of Oilfield Equipment and Services* published by World Oil, Houston, Tex. and an Otis type RQL no-go safety-valve nipple shown at page 4004 of the same catalog. In operation with the DK Otis safety valve, the lock mandrel M of the present invention is substituted for the locking mandrel illustrated at page 3998 of such catalog.

In preparation for operating the lock mandrel M and the running tool R of the invention, the lock mandrel is secured with a safety valve S as illustrated in FIG. 17B by threading the lower end of the lock mandrel packing mandrel 31 into the internally threaded upper end portion of the housing 150 of the safety valve. The operating fluid system of the safety valve, not shown, is connected to a suitable source of control fluid pressure which is used to pump the safety valve to the open position at which the operating tube 151 of the safety valve is at a lower end position as illustrated in FIG. 17B. The operating tube 151 is connected with a fluid responsive piston and a spring, not shown, permitting remote control of the valve from the surface after it is installed. In downhole operation the valve is held open by fluid pressure applied from the surface and when the pressure is released the spring closes the valve. When the valve is pumped open the spring is compressed applying an upward force on the operating tube.

With the safety valve pumped open, the running tool R is extended to maximum length by sliding the fishing neck 80 toward the sleeve 100. The running tool is then inserted into the connected lock mandrel M and safety valve S. As the running tool is inserted the collet fingers 132 move along the lock mandrel until the fingers pass into the expander sleeve 33 past the internal cam surface 52 with the collet heads 33 springing outwardly into the larger bore of the sleeve 33 below the cam surface 52. The heads 111 on the latch keys 102 engage the upper end of the retainer sleeve 30 moving into the bore of the sleeve below the internal tapered shoulder 41 into the bore portion 40 of the sleeve. The core 135 extends downwardly through the lock mandrel into the upper end of the safety valve. The fluid pressure holding the safety valve open is then released so that the spring engaged with the operating tube 151 of the safety valve urges the operating tube upwardly against the tapered end edge surface 138 on the prong 137 secured on the lower end of the core. The upward force of the safety valve spring lifting the core applies an upward force to the pin 141 which urges the key retainer sleeve 100 upwardly. The upward force on the sleeve 100 urges the upper latch keys 102 upwardly along the outer surface of the sleeve 90 above the release recess 95 in the sleeve so that the heads 111 of the keys are trapped or captured within the annulus between the bore 40 of the sleeve 30 around the sleeve 90 between the internal annular tapered surface 41 within the sleeve 30 and the lower tapered end edge surfaces **101*a* of the windows 101 in the key retainer sleeve 100. The upward force on the sleeve 100 is applied from the window surfaces 101*a* to the inside end surfaces 121 of the latch key heads 111 urging the latch keys upward and outwardly so that the upper outer surfaces 113 on the latch key heads are urged against the internal annular tapered surface 41 within the lock mandrel sleeve 30 locking the running tool with the sleeve 30. At the lower end of the running tool the collet heads 133 are held at normal positions by the outer surface of the core below the core recess 136 so that the surfaces 134 on the collet heads 133 are engageable with the cam surface 52 within the lock mandrel expander sleeve 33. The running tool is manipulated by pulling the fishing neck 80 away from the lock mandrel slightly until the shear pin holes 41 in the lock mandrel sleeve 30 line up with the shear pin holes 93 in the running tool sleeve 90. Shear pins are then inserted through the holes 41 of the lock mandrel into the holes 93 of the running tool pinning the lock mandrel on the running tool. FIGS. 17A and 17B illustrate the safety valve and lock mandrel connected on the running tool for running and setting the safety valve. It will be seen that the upper keys 102 of the running tool are engaged in the sleeve 30 of the lock mandrel M, the collet finger heads 133 are engaged in the expander sleeve 33 of the lock mandrel, and the expander sleeve 33 is at the lower end position at which the locking dogs 32** on the lock mandrel are at inward release positions. The lock mandrel and safety valve are then in condition for running into a well bore and setting in a landing nipple.

The running tool R is connected at the fishing neck 80 with a wireline tool string, not shown, used to lower the running tool, lock mandrel, and safety valve through a flow conductor in a well bore, not shown, into a landing nipple 160 as represented in FIG. 18B. The landing nipple is provided with an internal annular locking recess 161 and a no-go stop shoulder 162. The safety valve and lock mandrel are driven downwardly using jars in the wireline tool string until the integral no-go ring 45 on the lower end of the lock mandrel sleeve 30 engages the no-go shoulder 62 in the landing nipple. The seal assembly 34 moves downwardly along the seal surface 163 of the landing nipple below the shoulder 162. Further downward jarring applying downward forces to the fishing neck 80 drives the fishing neck downwardly until the lower end edge of the skirt 83 on the fishing neck engages the upper end edge of the mandrel sleeve 30 shearing the pins 155 connecting the running tool with the mandrel skirt. FIGS. 18A and 18B illustrate the safety valve and lock mandrel landed in the landing nipple on the no-go shoulder and the running tool manipulated to shear the pins 155 connecting between the running tool and the lock mandrel sleeve 30. The running tool remains coupled into the lock mandrel by means of the upper keys 102 and the collet fingers 132. The spring in the safety valve continues to exert upward force on the probe 137 and core 135 which is applied through the pin 141 to the upper setting sleeve 100 applying the upward and outward force from the sleeve window edges 101*a* to keep the retainer keys 102 tightly expanded in locking relation in the lock mandrel sleeve 30 against the shoulder 41 of the sleeve. Upward force is applied on the line, not shown, to the wireline tool string. A bind on the line greater than the weight of the tools in the string indicate that the safety valve S is in position in the landing nipple. The fishing neck 80 is jarred upwardly pulling the upper setting sleeve 90 and the lower setting sleeve 130 upwardly raising the collet fingers 132 between the core 135 and the key retainer sleeve 100 which remain held against upward movement due to the locking action of the upper retainer keys 102. As the collet fingers 132 are lifted the upper edge surfaces 134 on the collet heads 133 engage the tapered shoulder 52 within the lock mandrel expander sleeve 33 lifting the sleeve 33 within the locking dogs 32. As the sleeve 33 moves upwardly the cam surfaces 55 and 60 on the sleeve engage the internal cam surfaces 70 and 71 respectively in the locking dogs camming the dogs radially outwardly to fully expanded positions as illustrated in FIGS. 19A and 19B and in FIG. 1. The locking dogs 32 move outwardly until the outer bosses on the dogs engage the landing nipple locking recess 161 locking the lock mandrel M along with the safety valve S against longitudinal movement within the landing nipple. The lock mandrel expander sleeve 33 moves to an upper end position at which the cam surface 55 on the sleeve 33 engages the stop shoulder 42 within the sleeve 30 of the mandrel M. At the upper position of the sleeve 33 within the dogs 32 the dogs are firmly held in the radially expanded positions illustrated in FIGS. 19A and 19B and in FIG. 1. An upward force or bind is then applied to the line supporting the wireline tool string and fluid pressure is applied to the control line leading to the safety valve S. The control line pressure in the safety valve chamber against the piston on the safety valve operator tube 151 moves the safety valve operator tube slightly downwardly relieving the upward force of the spring in the safety valve on the operator tube which has been urging the tube against the running tool core holding the running tool locked in the lock mandrel by means of the upper retainer keys 102. The upward bind on the wireline then lifts the fishing neck 80 pulling the upper setting sleeve 90 and the lower setting sleeve 130 upwardly relative to the key retainer sleeve 100 and the core 135 of the running tool. The upward movement of the sleeves 90 and 130 raises the release recess 95 of the sleeve 90 into alignment behind the retainer key heads 111 and raises the collet finger heads 133 camming the heads into the recess 136 on the core. When the release recess 95 is aligned with the retainer key heads 111, the garter spring 123 squeezes the retainer keys 102 inwardly retracting the key heads 111 from engagement with the shoulder 41 at the upper end of the bore portion 40 in the lock mandrel sleeve 30 releasing the running tool from the lock mandrel. As the running tool is pulled upwardly the cam shoulder 52 within the lock mandrel sleeve 33 acts on the upwardly moving cam edges 134 on the collet finger heads 133. The collet finger heads 133 are squeezed inwardly into the recess 136 of the core releasing the collet finger heads from the lock mandrel expander sleeve. The frictional engagement of the packing assembly 34 on the lock mandrel M in the seal surface of the landing nipple below the no-go shoulder 162 restrains the lock mandrel from pulling out of the landing nipple while the lock mandrel is manipulated by the running tool for locking the mandrel in the landing nipple. If the lock mandrel does not properly release from the running tool, the mandrel and safety valve will be pulled back upwardly when the running tool is lifted. For example if the control pressure is not properly applied to the safety valve, the upward force on the probe surface 138 will not be relieved so that the upper latch keys 102 will not release from the lock mandrel shoulder surface 39. Similarly if the locking dogs 32 are not expanded into locking relation in the landing nipple locking recess 161 the expander sleeve 33 cannot be pulled upwardly thereby restraining the collet finger heads 133 which cannot be pulled upwardly along the core to align with the release recess 136 and therefore the running tool will be restrained in the lock mandrel at the collet fingers 132. In the event that such malfunctions occur allowing the running tool with the lock mandrel and the safety valve to be pulled upwardly from the landing nipple, the running tool, lock mandrel, and safety valve are forced back downwardly into the landing nipple repeating the required steps for setting the lock mandrel in the landing nipple and releasing the running tool. After proper release of the running tool from the lock mandrel, the lock mandrel is left releasably locked in the landing nipple and the safety valve is under the control of the control pressure operated from the surface for opening and closing the safety valve as required by operating conditions of the well. The expander sleeve 33 of the lock mandrel M is restrained against accidental release by engagement of the latch lips 72 within the dogs 32 in the latch recess 61 of the sleeve and by the annular latch flange 73 along the lower end portion of the sleeve being positioned above the internal annular latch flange 74 within the packing mandrel 31 of the lock mandrel.

It will be recognized that the apparatus of the invention comprising the lock mandrel M and the running tool R provides well tool structure adapted to running and setting in a no-go type landing nipple by application of a downward force and releasably locking of the lock mandrel M to hold the safety valve in place in a well bore by application of a reverse upward direction force. Accidental release and possible inadvertent locking or other malfunction during the driving of the lock mandrel downwardly into position in a landing nipple is avoided.

The lock mandrel M with the safety valve S is removable from the landing nipple by use of an Otis conventional GR or GS pulling tool as illustrated at pages 3988–3989 of the 1974–1975 "Composite Catalog of Oilfield Equipment and Services", supra. Such pulling tool is equpped with a prong connected with the pulling tool core for engaging and releasing the lock mandrel expander sleeve 33 by pushing the sleeve downwardly and for engaging the operating tube 151 of the safety valve S to hold the valve open while the mandrel and valve are being pulled.

A fail-safe feature of the running tool will permit release of the mandrel dogs 32 for pulling the running tool, mandrel M, and safety valve back out of a well. The set screw or screws 131 are selected to shear for releasing the lower setting sleeve 130 from the upper setting sleeve 90. If there is a malfunction, for example, in control fluid pressure to the safety valve after the mandrel is locked, an upward pull on the head 80 will shear the screws 131. The head is then driven downwardly which forces the upper setting sleeve downwardly against the lower setting sleeve and against the expander sleeve 33 which is forced down to a lower end position from behind the dogs 32 releasing the dogs to move inwardly. The head 80 is then pulled upwardly, but since the lower setting sleeve 130 has been released from the upper sleeve 90, the collet fingers 132 are not pulled up in the expander sleeve 33, and thus the expander sleeve is not moved behind the dogs 32 which remain released as the pulling tool, mandrel, and safety valve are pulled. The mandrel can therefore be pulled without resetting the locking dogs.

A second embodiment of the running tool of the invention is shown in FIGS. 20A and 20B through 33 which illustrate a running tool R2. Referring to FIGS. 20A and 20B, the running tool R2 has a top sub or head 200 provided with an externally threaded pin 201 for connecting the running tool with a tool string such as operated on a wireline for lowering the running tool and the lock mandrel secured to a well tool such as a safety valve in a well bore. Included in the running tool supported from the top sub are an upper latch assembly 202 for releasably coupling the tool with a lock mandrel body and a lower latch assembly 203 for releasably connecting the running tool with the expander sleeve of the lock mandrel. The upper and lower latch assemblies are supported from the top sub along a core 204 which transfers an upward force from the operator tube of the well tool connected with the lock mandrel such as a safety valve to the upper latch assembly so that the upper latch assembly remains coupled with the lock mandrel body until a control line pressure opens the safety valve supported from the lock mandrel. The core also has structural features for operation of the lower latch assembly to set the lock mandrel in a landing nipple and release the running tool from the lock mandrel.

As shown in FIGS. 20A and 20B the top sub 200 has a tubular skirt 205 defining a bore 210 having a reduced internally threaded upper end portion 211. A plurality of bypass ports 212 are formed in the top sub opening into the upper end of the bore 210 for fluid flow through the running tool as the tool is lowered and raised in a well bore. An upper setting sleeve 213 is seoured in concentric spaced relation within the top sub oonnected by an externally threaded upper end section into the threaded portion 211 of the top sub bore. The upper setting sleeve has an enlarged lower end section 214 provided with an internal annular locking recess 215. The upper end edge of the sleeve enlarged portion 214 defines an external annular stop shoulder 220 around the upper setting sleeve. The upper setting sleeve is provided with two longitudinal slots 221 aligned along opposite sides of the sleeve for sliding longitudinal movement of a roll pin 222 the purpose of which is described hereinafter. The upper latch assembly 202 includes a retainer sleeve 223 slidably telescoped between the skirt 205 and the upper setting sleeve 213. The retainer sleeve has a head portion 224 provided with an internal annular shoulder 225 which is engageable by the shoulder 220 on the upper setting sleeve 213. The upper end portion of the core 204 is telescoped into the upper setting sleeve and pinned to the retainer sleeve by the roll pin 222 so that the core, roll pin, and retainer sleeve move as a unit. As shown in FIG. 21 the retainer sleeve has diametrically positioned holes 230 for the roll pin 222. The lower end portion of the retainer sleeve 223 is provided with four circumferentially spaced latch key windows 231 which communicate at the lower ends with longitudinal slots 232 extending along the surface of the retainer sleeve below each of the windows 231 opening at the upper end into the window and having a longitudinal axis coincident with the longitudinal axis of the window. The bottom of the lower end portion of each of the slots 232 is provided with a circular recess 233. An external annular recess 234 is formed around the retainer sleeve intersecting the longitudinal slots 232 between the circular recesses 233 and the central portion of the slots 232. As shown in FIG. 20B a latch key 235 is positioned in each of the windows 231 biased radially inwardly by a flat leaf spring 240. A retainer band 241 in the annular recess 234 holds the leaf springs in position. The configuration of each of the keys 235 is shown in FIGS. 24, 25, and 26. As evident in FIGS. 24 and 25 the outer locking end portion, the lower end portion of FIG. 20B, of each of the keys is provided with two laterally aligned locking bosses 242 spaced on opposite sides of a spring recess 243. The longitudinal side edges of the keys 235 are each provided with spaced retainer lips 244 which hold the keys in the windows 231. The inside surfaces of each of the keys 235 as illustrated in FIGS. 25 and 26 are defined by cylindrical concave surfaces which fit around the portion of the lower setting sleeve 203 within the keys. As seen in FIG. 20B showing a side longitudinal edge of one of the springs 241, each of the springs lies along a central flat portion in a slot 232 below the window 231 of the retainer sleeve with an upper end portion of the spring resting in the recess 243 of the key 235 in the window 231 while a lower end portion of the spring bent at 90° to the flat body portion of the spring engages the round recess 233 opening into slot 232. The retainer band 241 around the flat portion of the springs holds the springs in the slots 232 with end portions of the springs each resting in one of the slots 243 of the adjacent key 235 biasing the lower ends of the keys inwardly against the outer surface of the lower setting sleeve within the keys. The keys 235 function to couple the running tool R2 with the body of the lock mandrel M2 as shown in FIGS. 34A–37B. The keys 235 as shown in FIG. 20B are in the outward lock positions at which the mandrel M2 is locked on the running tool.

Referring to FIGS. 20B, and 27–29, the lower setting sleeve 203 telescopes in sliding relation into the upper latch assembly 202 performing a duel function in the operation of the running tool including release of the latch keys 235 as well as operating the lock mandrel M2. The lower setting sleeve has a reduced upper end portion 250 which slides on a reduced upper end portion 251 of the core 204 above an external annular stop shoulder 252 on the core. The upper end portion 250 of the lower setting sleeve 203 has circumferentially spaced windows 253 each sized and shaped to receive a transfer lug 254 which serve release and coupling functions between the lower setting sleeve 203 and the upper setting sleeve 213. At radially inward release positions the transfer lugs 254 move along inward portions into an external annular release recess 255 formed around the core 204 above the shoulder 252 on the core. Further details of the windows 253 on the upper end portion of the lower setting sleeve 203 and the transfer lugs 254 are shown in FIGS. 28 and 30–33. The lugs shown in FIGS. 31–33 are substantially enlarged in size compared with the scale of the setting sleeve as shown in FIGS. 27–30. Each of the lugs is a circular segment having outer latching bosses 254*a* and end flanges 254*b* as shown in FIG. 33 for holding the lugs within the windows 253. The depth of each of the lugs is substantially greater than the wall thickness of the sleeve portion 250 at the windows so that the bosses 254*a* of the lugs may extend outwardly beyond the outer surface of the sleeve portion 250 when the lugs are at fully expanded positions. At inward positions of the lugs as shown in FIG. 20B the outer surfaces of the bosses 254*a* are in alignment with the outer surface of the sleeve portion 250 and thus are at release positions.

As seen in FIGS. 20B and 27, the lower setting sleeve 203 has an external annular upper latch key release recess 255 which permits inward movement of the upper latch keys 235 when the recess 255 is aligned within the keys. The lower end portion of the lower setting sleeve 203 is provided with circumferentially spaced windows 260 each of which receives a locking lug 261 for releasably locking the lower setting sleeve with the locking sleeve of the lock mandrel M2 when supported on the running tool. The locking lugs 261 have the same shape as the lugs 254 shown in FIGS. 30–33 including end flanges for holding the lugs within the windows 260 while permitting the lugs to expand outwardly sufficiently to releasably engage the lock mandrel setting sleeve when the setting sleeve is disposed around the lower setting sleeve 203 of the running tool. The lower setting sleeve 203 is also provided with circumferentially spaced upwardly extending integral collet fingers 262 which are radially flexible and provided with external unlocking shoulders 263 and internal operating bosses 264. The unlocking lips or shoulders 263 on the collets 262 are engageable with the end edge of the locking mandrel locking sleeve for unlocking the mandrel with the running tool in the event that it is necessary to retrieve the mandrel with the running tool. The internal bosses 264 on the collets 262 are engageable with the outer surface of the core which provides a metal backup to securely the collet fingers outwardly at the unlocking positions.

Referring to FIGS. 20A and 20B, the core 204 is slidably disposed within the lower setting sleeve 203 and the upper setting sleeve 213. The core is secured at the upper end with the upper end of the retainer sleeve 223 by the roll pin 222 which passes through the diametrically opposed slots 221 in the upper setting sleeve so that the core and the retainer sleeve move together as a unit. A coil spring 265 is confined between the upper end edge of the core within the bore of the upper setting sleeve and a downwardly facing surface at the end of the head assembly bore biasing the core downwardly. The core is provided with longitudinally spaced external annular release recesses 270 and 271 positioned to receive the internal bosses 264 on the collet fingers 262 and the locking lugs 261, respectively, at the release position of the core relative to the lower locking sleeve 203. A running prong 272 is threaded on the lower end of the core below the lower end of the lower setting sleeve 203. The upper end edge 273 of the prong engages the lower end edge 274 of the setting sleeve 203 in the relative positions of the running tool parts shown in FIGS. 20A and 20B. The lower end of the prong is provided with an inwardly tapered annular surface 275 for engagement of the prong with an operator tube of a well tool below the running tool such as a safety valve.

Referring to FIG. 34B, the running tool R2 is operable with the lock mandrel M2 for setting the lock mandrel in a landing nipple to support a well tool such as a safety valve in a well bore below the landing nipple. Mandrel M2, FIG. 34B, is functionally identical to the lock mandrel M of FIG. 1 differing only in minor structural features. The lock mandrel M2 has a tubular mandrel body including a main section 280 provided with circumferentially spaced windows 281 and a lower section 282 threaded into the lower end of the section 280. The section 280 has an external annular stop shoulder 283 which stops at and seats on a seat surface in a landing nipple, not shown, similar to the landing of the mandrel M in the landing nipple 160 at the shoulder 162 as shown in FIG. 18B. A radially expandible locking dog 284 is disposed in each of the windows 281 of the mandrel body section 280. An expander sleeve 285 is slidably disposed within the mandrel body sections within the locking dogs 284 for movement between a lower end position at which the dogs are retracted as shown in FIG. 34B and an upper end position at which the dogs 284 are expanded as illustrated in FIG. 37B. The body mandrel 290 of a safety valve, not shown, is secured at the upper end thereof into the lower end of the body section 282 of the mandrel M2 for supporting the safety valve from the mandrel. The safety valve has an operating tube 291 having a downwardly and inwardly convergent upper end edge 292 which is engageable with the lower end surface 275 on the running prong of the running tool R2 for holding the running prong and core of the running tool at an upper end position when the running prong on the core engages the safety valve operating tube during the running, and landing of the mandrel M2 prior to pumping the safety valve fully open with operating fluid from the surface. When using the lock mandrel M2, an annular seal such as a seal 34 as shown in FIG. 1 is located on the safety valve body rather than on the mandrel body as shown in FIG. 1. Otherwise the mandrels M1 and M2 are essentially identical in both function and structure. The body section 280 of the mandrel M2 has an internal annular locking recess 293 for the retainer dogs or latch keys 235 on the running tool R2.

To run and set the mandrel M2 at a landing nipple in a well bore with a safety valve supported from the mandrel, the mandrel and running tool R2 are assembled at the surface by inserting the running tool prong 272 and core 203 and the retainer sleeve 223 with the retainer dogs 235 into the mandrel body and locking sleeve as shown in FIGS. 34A and 34B. The running tool may be coupled with the lock mandrel using the following procedure. The lock mandrel is made up to the safety valve and the entire assembly is placed in a vice with the lock mandrel in a locked condition at which the locking keys 284 are fully expanded. The running tool is then inverted with the top sub 200 down and the prong 204 extending upwardly. The prong is pulled upwardly and the lower setting sleeve 203 should drop freely so that the retaining dogs 235 may retract and the locking lugs 261 are free to retract. The safety valve, not shown, is then pumped open with a hand pump. The running tool is inserted into the lock mandrel until the retaining dogs 235 are within the locking recess 293 of the lock mandrel body section 280. The unlocking collets 262 on the lower setting sleeve snap into place with the unlocking shoulders 263 engaging the end edge of the lock mandrel expander sleeve 285 and the locking lugs 261 are aligned with and engaging the expander sleeve operating shoulder 295 in the general relationship shown in FIGS. 35A and 35B except that the locking sleeve of the lock mandrel M2 is at the position of FIGS. 37A and 37B. A set of wireline type jars and a short section of stem are then attached to the threaded end 201 of the top sub 200. With the safety valve still pumped open, the running tool is jarred toward the lock mandrel M2 until the expander sleeve 285 of the lock mandrel is driven toward the safety valve to the unlocked position of FIGS. 34A and 34B. This also shifts the lower setting sleeve 203 to the position of FIGS. 34A and 34B at which the retainer dogs 235 are held outwardly in locking positions within the recess 293 of the lock mandrel body section 280. The pressure is then released on the safety valve permitting the spring in the safety valve, not shown, to urge the operating tube 291 of the safety valve against the end edge 275 of the running prong 272. The force of the safety valve operating tube against the running prong holds the running prong at an upper position as shown in FIGS. 34A and 34B at which the recess 255 is aligned with the transfer lugs 254 so that the lugs are free to move inwardly into the recess and cannot be engaged by the upper setting sleeve 213. The running tool is then checked by first pulling the top sub 200 of the running tool outwardly away from the lock mandrel M2 to a position of full extension as essentially shown in FIGS. 34A and 34B and pushing the top sub toward the lock mandrel to essentially the position of FIGS. 35A and 35B to insure that the top sub will move through the full length of travel without engaging the transfer lugs. At this stage the running tool, lock mandrel, and safety valve assembly are ready to run into a well bore.

The running tool R2 with the lock mandrel M2 and safety valve are assembled in a wireline tool string and lowered in a well bore into a landing nipple such as represented in FIG. 18B. The lock mandrel enters the nipple and is jarred downwardly until the stop shoulder 283 on the lock mandrel body is seated against the no-go shoulder such as the shoulder 162 in the landing nipple represented in FIG. 18B. The running tool and mandrel with the safety valve are lowered as represented in FIGS. 34A and 34B. During the lowering of the tool assembly the top sub with the skirt 205 and the upper setting sleeve 213 remain telescoped to the upper end position illustrated at which the shoulder 225 of the retainer sleeve hangs on the shoulder 220 of the upper setting sleeve. As the lock mandrel enters the landing nipple and is jarred downwardly the top sub is telescoped downwardly over the retainer sleeve and upper end portion of the core to the position shown in FIGS. 35A and 35B at which the lower end edge of the top sub skirt 205 engages the upper end edge of the lock mandrel body section 280 for driving the lock mandrel into the landing nipple against the no-go shoulder. After the lock mandrel is against the no-go shoulder the relative positions of the parts of the running tool and lock mandrel are seen in FIGS. 35A and 35B. The control line pressure to the safety valve is then increased to the level required to fully open the valve which moves the operating tube 291 of the safety valve downwardly to the position shown in FIGS. 36A and 36B thereby removing the upward force from the running tool core 204. With the core no longer forced upwardly by the safety valve operating tube, the spring 265 in the top sub expands shifting the core 204 downwardly moving the release recess 255 below the transfer lugs 254 so that the surface of the core above the release recess expands the lugs into the recess 215 of the upper setting sleeve 213 as illustrated in FIGS. 36A and 36B. The increase of the control line pressure opening the safety valve must be done at the time that the top sub of the running tool is still at the lower end position and thus before an upward pull is applied to the top sub so that the upper setting sleeve 213 will be telescoped downwardly around the transfer lugs as illustrated. An upward force is then applied to the top sub telescoping the top sub including the skirt 205 and the upper setting sleeve 213 upwardly relative to the retainer sleeve 223 and the core 204. When the upper setting sleeve is pulled upwardly to the position of FIGS. 37A and 37B the transfer lugs within the recess 215 of the upper setting sleeve are lifted raising the lower setting sleeve 203 for expanding the locking keys 284 of the lock mandrel M2 and releasing the retainer keys 235 of the running tool from the lock mandrel body section 280. This sequence of operation will be better understood by reference to both sets of FIGS. 36A and 36B and 37A and 37B. As the upward force is applied to the lower setting sleeve the lugs 261 are pulled upwardly against the shoulder 295 within the lock mandrel locking sleeve 285 forcing the sleeve upwardly within the locking keys 284 expanding the keys to the positions shown in FIGS. 37A and 37B which lock the mandrel M2 in the landing nipple. By the time that the locking sleeve 285 is lifted to the locking position, the lugs 261 are aligned with the release recess 271 in the running tool core 204 so that the lugs 261 are cammed inwardly to release positions into the recess 271 thereby releasing the lugs from the locking shoulder of the locking sleeve. Simultaneously the unlocking collets 262 on the lower setting sleeve are cammed inwardly into the release recess 270 of the core 204. Also simultaneously the upward movement of the lower setting sleeve aligns the release recess 255 of the lower setting sleeve with the retainer keys 235 which are squeezed inwardly by the springs 240 releasing the keys from the locking recess 293 in the body section 280 of the lock mandrel M2. These release positions of the lugs 261, the unlocking collets 262, and the retainer keys 235 are illustrated in FIGS. 37A and 37B. With the running tool released from both the body of the lock mandrel M2 and the locking sleeve of the lock mandrel, the running tool is telescoped upwardly out of the lock mandrel and pulled back to the surface by the wireline leaving the lock mandrel M2 with the safety valve locked at the landing nipple in the well bore.

If an operational problem prevents the control line pressure from fully opening the safety valve and thereby removing the upward force of the safety valve operating tube from the prong and core of the running tool, it will be apparent that the core will remain in the positions of FIGS. 34A and 34B and will not be shifted upwardly to the position of FIGS. 36A and 36B. Thus if the control line pressure does not fully open the safety valve, upward jarring on the running tool will not lock the lock mandrel M2 in the landing nipple but rather will extract the lock mandrel M2 and the safety valve from the landing nipple because the relationship of the top sub will be as shown in FIGS. 34A and 34B the parts being at positions at which the transfer lugs 254 cannot be engaged by the upper setting sleeve and thus the lock mandrel M2 cannot be locked in the landing nipple but rather will be pulled from the nipple by the running tool. This of course is one of the principle procedures of the invention which precludes leaving the lock mandrel and safety valve in the well bore if the safety valve is malfunctioning.

If after the tool operator has extracted the running tool R2 from the lock mandrel M2 some condition develops which indicates that the lock mandrel and safety valve should be retrieved, the running tool may be used as a pulling tool. It is required however when so using the running tool that the safety valve be operational because the safety valve must be pumped fully open with the operator tube 291 of the safety valve at the lower position represented in FIGS. 36A and 36B and 37A and 37B. In such event the running tool is lowered and telescoped back into the lock mandrel entering the lock mandrel in the condition represented in FIGS. 37A and 37B so that the retainer dogs 235 may enter the body section 280 of the lock mandrel and the lugs 261 as well as the unlocking collets 262 are at inward positions for entering the lock mandrel. When the unlocking collet heads approach the locking sleeve 285 of the mandrel M2 in essentially the position of FIGS. 37A and 37B, the unlocking collets expand outwardly until the shoulders 263 on the collet heads engage the end edge of the locking sleeve 285 so that further downward force on the running tool top sub drives the lower setting sleeve 203 with the unlocking collets downwardly moving the locking sleeve 285 downwardly to the release position represented in FIGS. 36A and 36B. The downward movement of the lower setting sleeve also moves the release recess 255 around the sleeve below the retainer dogs 235 shifting the full diameter surface of the lower setting sleeve behind the dogs which are expanded back into the recess 293 of the lock mandrel body section 280. After the control line pressure on the valve has been decreased and the operating member 291 of the safety valve moves up, an upward force on the top sub will pull the running tool and lock mandrel with the safety valve back upwardly out of the landing nipple.

What is claimed is:

1. A lock mandrel and running tool assembly for setting and locking a well tool in a landing nipple along a well bore comprising a lock mandrel having a body provided with side windows, a support shoulder on said body for supporting said mandrel in a no-go landing nipple, a radially movable locking dog in each of said side windows, a longitudinally movable expander sleeve in said body movable within said dogs for expanding and locking said dogs outwardly and releasing said dogs for inward movement, and means for connecting said mandrel body to said well tool and a running tool having a head assembly for connection with an operating tool string, an upper latch key assembly slidably connected with said head assembly for coupling said running tool with said lock mandrel body, a lower latch assembly operable by said head assembly for coupling said running tool with and raising said lock mandrel expander sleeve, a core having a prong end coupled with said head assembly for engaging a well tool operator member to apply a force from said operator member to said upper latch key assembly to lock said key assembly with said lock mandrel body, and said head assembly and core being movable in a direction opposite to the direction of setting said assembly in said landing nipple to expand said lock mandrel locking dogs and release said running tool from said lock mandrel.

2. A lock mandrel and running tool assembly in accordance with claim 1 wherein said lower latch assembly is a collet connected with said head assembly and having collet finger heads engageable with said lock mandrel expander sleeve for expanding said locking dogs.

3. A lock mandrel and running tool assembly in accordance with claim 1 wherein said lower latch assembly comprises a lower setting sleeve and radially movable locking lugs carried by said lower setting sleeve to engage and move said expander sleeve of said lock mandrel and said head assembly includes an upper setting sleeve releasably connectible with said lower setting sleeve and said lower setting sleeve includes means for releasable engagement with said upper setting sleeve.

4. A lock mandrel and running tool assembly in accordance with claim 3 including radially movable transfer lugs carried by said lower setting sleeve for releasably connecting said upper and lower setting sleeves.

5. A lock mandrel and running tool assembly in accordance with claim 4 wherein said lower setting sleeve includes a release collet for engaging said expander sleeve to release said lock mandrel locking dogs.

6. A lock mandrel and running tool assembly in accordance with claim 5 wherein said core has spaced external annular recesses for coacting with said locking lugs and collet on said lower setting sleeve.

7. A lock mandrel and running tool assembly in accordance with claim 1, wherein said lock mandrel body has an internal annular recess for engagement of said upper latch assembly and said expander sleeve has an internal annular recess for engagement by said lower latch assembly.

8. A lock mandrel and running tool assembly in accordance with claim 7 including latch means for releasably latching said expander sleeve at a position at which said locking dogs are expanded.

9. A lock mandrel and running tool assembly in accordance with claim 8 wherein said latch means comprises a latch flange around said expander sleeve, and a latch flange within said mandrel body.

10. A lock mandrel and running tool assembly in accordance with claim 9, wherein said support shoulder on said mandrel body comprises an annular no-go ring.

11. A lock mandrel and running tool assembly in accordance with claim 10 wherein said locking dogs are each provided with internal cam surfaces for expanding said dogs and said expander sleeve is provided with external cam surfaces for engaging said locking dog cam surfaces.

12. A lock mandrel and running tool assembly in accordance with claim 1 wherein said lower latch assembly is a collet movable along said core and said core has an external annular release recess for releasing said collet from said lock mandrel expander sleeve when said recess is aligned with said collet fingers.

13. A lock mandrel and running tool assembly in accordance with claim 12 including an upper setting sleeve connected between said head assembly and said collet for moving said collet along said core, said upper setting sleeve having an external annular release recess alignable with said upper latch key assembly for releasing said upper latch key assembly simultaneously with release of said collet.

14. A lock mandrel and running tool assembly in accordance with claim 13 wherein said latch key assembly and said core are pinned together and movable as a unit relative to said head assembly for operating said lock mandrel expander sleeve and releasing said running tool from said lock mandrel.

15. A lock mandrel and running tool assembly in accordance with claim 14 wherein said upper latch key assembly includes a key retainer sleeve pinned to said core and said retainer sleeve includes a tapered cam surface engageable with cam surfaces on said latch key assembly for urging said latch key assembly into locking relationship with said lock mandrel body responsive to a force applied to said core from a well tool coupled with said locking mandrel.

16. A running tool for setting and locking a lock mandrel in a landing nipple along a well bore comprising: a head assembly for connection of said running tool with an operating tool string; an upper latch key assembly slidably connected with said head assembly for coupling said running tool with the body of said lock mandrel; a lower latch assembly operable from said head assembly for coupling with and lifting an expander sleeve in said lock mandrel; a core secured with said upper latch key assembly and slidable in said lower latch assembly said core having a lower end prong for engagement with an operating member of said well tool below said lock mandrel to apply a force from said well tool to said upper latch key assembly for holding said upper latch key assembly in locked relation with said lock mandrel body, and said core having latch assembly lock and release means movable relative to said lower latch assembly to operate said lower latch assembly in response to movement of said head assembly for moving said lock mandrel expander sleeve and releasing said running tool from said lock mandrel.

17. A running tool in accordance with claim 16 wherein said upper latch key assembly includes a key retainer sleeve having windows therein and a plurality of radially movable latch keys in said windows, pin means between said key retainer sleeve and said core for holding said retainer sleeve and said core together as a unit when said head assembly is moved to shift said expander sleeve in said lock mandrel for expanding locking dogs of said lock mandrel and thereafter for releasing said running tool from said lock mandrel.

18. A running tool in accordance with claim 17 wherein said lower latch assembly is a collet secured through shear pin means with said head assembly for fail-safe removal of said running tool and lock mandrel from a well bore.

19. A running tool in accordance with claim 16 wherein said lower latch assembly includes a lower setting sleeve having means for releasably engaging an expander sleeve in said lock mandrel, and said head assembly includes an upper setting sleeve releasably connectible with said lower setting sleeve at one of a plurality of longitudinal positions of said core.

20. A running tool in accordance with claim 19 including radially movable locking lugs and radially movable transfer lugs carried by said lower setting sleeve, said locking lugs being engageable with said expander sleeve of said lock mandrel and said transfer lugs being engageable with said upper setting sleeve.

21. A running tool in accordance with claim 20 wherein said lower setting sleeve includes release collet fingers for engaging said lock mandrel expander sleeve to release said lock mandrel from a landing nipple.

22. A running tool in accordance with claim 21 wherein said core has longitudinally spaced external annular release recesses for receiving said locking lugs, said transfer lugs, and said release collet fingers.

23. A running tool in accordance with claim 22 wherein a first release recess in said core is aligned within said transfer lugs at a first upper end position of said core and second and third release recesses on said core are aligned with said locking lugs and said release collet finger and said first release recess is misaligned from said transfer lugs at a second lower position of said core.

24. A running tool in accordance with claim 23 including a spring between said head assembly and said core biasing said core toward said second lower position.

25. A running tool for setting and locking a lock mandrel in a landing nipple along a well bore, said lock mandrel having an expander sleeve movable upwardly for locking said mandrel at said landing nipple, said running tool comprising: a head assembly having means at an upper end thereof for connection with a wireline tool string, said head assembly including a tubular outer skirt and an upper setting sleeve disposed in concentric spaced relation within said skirt, said setting sleeve having an internal annular operating flange at the lower end thereof and an internal annular recess above said operating flange, and diametrically opposed longitudinal slots above said recess; a tubular retainer sleeve slidable within said skirt around said upper setting sleeve, said retainer sleeve having circumferentially spaced windows opening through said sleeve below said skirt; a radially removable retainer key in each of said windows of said retainer sleeve for releasably locking said running tool with the body of said lock mandrel; a spring coupled with each of said retainer keys biasing each of said keys radially inwardly; an elongated tubular core slidably disposed along an upper end thereof within said upper setting sleeve, said core having longitudinally spaced external annular release recesses; a roll pin connected transversely through upper end portions of said retainer sleeve and said core passing through said longitudinal slots in said upper setting sleeve for movement of said retainer sleeve and said core as a unit; a spring within said head assembly engaging an upper end edge of said core biasing said core downwardly relative to said head assembly; a lower setting sleeve slidably disposed around said core within said retainer sleeve and having an upper end portion movable into a lower end portion of said upper setting sleeve, said lower setting sleeve having an external annular release recess alignable within said retainer keys at a release position of said lower setting sleeve permitting said retainer keys to move inwardly around said lower setting sleeve for release of said running tool from said lock mandrel body, said lower setting sleeve having circumferentially spaced windows along an upper end portion thereof and circumferentially spaced windows along a lower end portion thereof; radially movable transfer dogs disposed in said upper windows of said lower setting sleeve for releasably coupling said lower setting sleeve with said upper setting sleeve; locking dogs in said lower windows of said lower setting sleeve for releasably coupling said lower setting sleeve with said expander sleeve of said lock mandrel; said release recesses along said core and along said lower setting sleeve being positioned for said core holding said locking lugs in expanded lock relation within said lock mandrel expander sleeve and said transfer lugs at inward release positions when said core is at a first upper position and for holding said transfer lugs outwardly and said locking lugs outwardly at a second lower position of said core and a first lower position of said lower setting sleeve whereby said upper setting sleeve is coupled with said lower setting sleeve for moving said lock mandrel expander sleeve upwardly to lock said lock mandrel at a landing nipple and said locking lugs are aligned with one of said release recesses around said core at a second upper position of said lower setting sleeve for release of said locking lugs from said lock mandrel expander sleeve and said release recess around said lower setting sleeve is aligned with said retainer keys for release of said running tool from said lock mandrel body.

26. A running tool in accordance with claim 25 including integral release collet fingers in said lower setting sleeve for engaging said expander sleeve of said lock mandrel to return said expander sleeve downwardly to a release position, said unlocking collet fingers being movable into one of said release recesses of said core when said running tool is released from said lock mandrel.

* * * * *

UNITED STATES PATENT AND TRADEMARK OFFICE

CERTIFICATE OF CORRECTION

PATENT NO. : 4,545,434

DATED : October 8, 1985

INVENTOR(S) : Brian D. Higgins

It is certified that error appears in the above-identified patent and that said Letters Patent is hereby corrected as shown below:

On the title page, left column, below the line identified "inventor" insert

--Assignee: Otis Engineering Corporation, Dallas, TX.--

Signed and Sealed this

*Twenty-fifth* Day of *February 1986*

[SEAL]

*Attest:*

DONALD J. QUIGG

*Attesting Officer*

*Commissioner of Patents and Trademarks*